US006099252A

United States Patent [19]

Manning et al.

[11] Patent Number: 6,099,252

[45] Date of Patent: Aug. 8, 2000

[54] AXIAL SERPENTINE COOLED AIRFOIL

[75] Inventors: Robert F. Manning, Newburyport; Paul J. Acquaviva, Wakefield; Daniel E. Demers, Ipswich, all of Mass.

[73] Assignee: General Electric Company, Cincinnati, Ohio

[21] Appl. No.: 09/192,227

[22] Filed: Nov. 16, 1998

[51] Int. Cl.[7] ..... F01D 5/08

[52] U.S. Cl. ..... 416/97 R; 416/96 R; 415/116

[58] Field of Search ..... 415/115, 116; 416/96 R, 97 R

[56] References Cited

U.S. PATENT DOCUMENTS 5,356,265 10/1994 Kercher .
5,387,085 2/1995 Thomas, Jr. et al. .
5,498,133 3/1996 Lee .
5,536,143 7/1996 Jacala et al. ..... 416/96 R
5,591,007 1/1997 Lee et al. .
5,902,093 10/1999 Liotta et al. ..... 416/97 R
5,967,752 10/1999 Lee et al. ..... 416/97 R
5,997,251 12/1999 Lee ..... 416/97 R

*Primary Examiner*—Edward K. Look
*Assistant Examiner*—Ninh Nguyen
*Attorney, Agent, or Firm*—Andrew C. Hess; Rodney M. Young

[57] ABSTRACT

A gas turbine engine airfoil includes an axial serpentine cooling circuit therein. A plurality of the serpentine circuits are preferably stacked in a radial row along the airfoil trailing edge for cooling thereof.

20 Claims, 3 Drawing Sheets

AXIAL SERPENTINE COOLED AIRFOIL

BACKGROUND OF THE INVENTION

The present invention relates generally to gas turbine engines, and, more specifically, to cooled turbine blades and stator vanes therein.

In a gas turbine engine, air is pressurized in a compressor and channeled to a combustor wherein it is mixed with fuel and ignited for generating hot combustion gases. The combustion gases flow downstream through one or more turbines which extract energy therefrom for powering the compressor and producing output power.

Turbine rotor blades and stationary nozzle vanes disposed downstream from the combustor have hollow airfoils supplied with a portion of compressed air bled from the compressor for cooling these components to effect useful lives thereof. Any air bled from the compressor necessarily is not used for producing power and correspondingly decreases the overall efficiency of the engine.

In order to increase the operating efficiency of a gas turbine engine, as represented by its thrust-to-weight ratio for example, higher turbine inlet gas temperature is required, which correspondingly requires enhanced blade and vane cooling.

Accordingly, the prior art is quite crowded with various configurations intended to maximize cooling effectiveness while minimizing the amount of cooling air bled from the compressor therefor. Typical cooling configurations include radial serpentine cooling passages for convection cooling the inside of blade and vane airfoils, which may be enhanced using various forms of turbulators. Internal impingement holes are also used for impingement cooling inner surfaces of the airfoils. And, film cooling holes extend through the airfoil sidewalls for providing film cooling of the external surfaces thereof.

Airfoil cooling design is rendered additionally more complex since the airfoils have a generally concave pressure side and an opposite, generally convex suction side extending axially between leading and trailing edges. The combustion gases flow over the pressure and suction sides with varying pressure and velocity distributions thereover. Accordingly, the heat load into the airfoil varies between its leading and trailing edges, and also varies from the radially inner root thereof to the radially outer tip thereof.

The airfoil trailing edge is necessarily relatively thin and requires special cooling configurations therefor. For example, the trailing edge typically includes a row of trailing edge outlet holes through which a portion of the cooling air is discharged after traveling radially outwardly through the airfoil. Disposed immediately upstream of the trailing edge holes are typically turbulators in the form of pins for enhancing trailing edge cooling. The cooling air flows axially around the turbulators and is simply discharged from the trailing edge holes into the combustion gas flowpath.

Accordingly, it is desired to provide an airfoil having improved trailing edge cooling.

BRIEF SUMMARY OF THE INVENTION

A gas turbine engine airfoil includes an axial serpentine cooling circuit therein. A plurality of the serpentine circuits are preferably stacked in a radial row along the airfoil trailing edge for cooling thereof.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
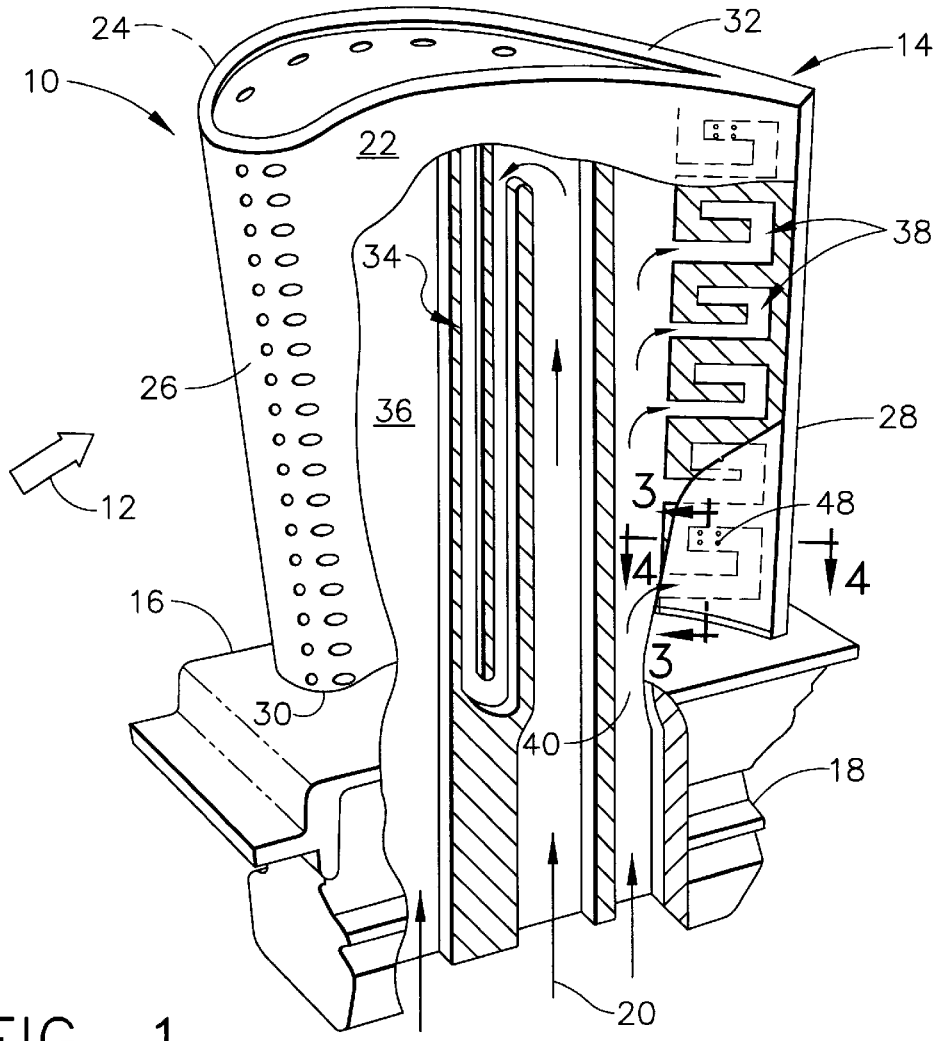
FIG. 1 is an isometric, partly sectional view of an exemplary rotor blade for a turbine in a gas turbine engine having an airfoil cooled in accordance with an exemplary embodiment of the present invention.

Illustrated in FIG. 1 is a rotor blade 10 configured for attachment to the perimeter of a turbine rotor (not shown) in a gas turbine engine. The blade 10 is disposed downstream of a combustor and receives hot combustion gases 12 therefrom for extracting energy to rotate the turbine rotor for producing work.

The blade 10 includes an airfoil 14 over which the combustion gases flow, and an integral platform 16 which defines the radially inner boundary of the combustion gas flowpath. A dovetail 18 extends integrally from the bottom of the platform and is configured for axial-entry into a corresponding dovetail slot in the perimeter of the rotor disk for retention therein.

In order to cool the blade during operation, pressurized cooling air 20 is bled from a compressor (not shown) and routed radially upwardly through the dovetail 18 and into the hollow airfoil 14. The airfoil 14 is specifically configured in accordance with the present invention for improving effectiveness of the cooling air therein. Although the invention is described with respect to the airfoil for an exemplary rotor blade, it may also be applied to turbine stator vanes.

As initially shown in FIG. 1, the airfoil 14 includes a first or pressure sidewall 22 and a circumferentially or laterally opposite second or suction sidewall 24. The suction sidewall 24 is generally convex and the pressure sidewall 22 is generally concave, and the sidewalls are joined together at axially opposite leading and trailing edges 26,28 which extend radially or longitudinally from a root 30 at the blade platform to a radially outer tip 32.

An exemplary airfoil is illustrated in FIG. 1 and has a profile conventionally configured for extracting energy from the combustion gases 12. For example, the combustion gases 12 first impinge the airfoil 14 in the axial, downstream direction at the leading edge 26, with the combustion gases then splitting circumferentially for flow over both the pressure sidewall 22 and the suction sidewall 24 until they leave the airfoil at its trailing edge 28.

But for the present invention, the airfoil 14 illustrated in FIG. 1 may be conventionally configured to cool the leading edge 26 and mid-chord regions thereof. For example, a conventional three-pass radial serpentine cooling circuit 34 may be used for cooling the mid-chord region of the airfoil. The air 20 enters the radial serpentine circuit 34 through the dovetail 18 and flows primarily in radially extending channels joined together end-to-end by axially extending reversing channels or bends for redirecting the cooling air in multiple radial or longitudinal paths up and down the airfoil. The air is discharged from the serpentine circuit either through outlet holes in the tip thereof or through film cooling holes in the sidewalls, or both.

The airfoil 14 may also include a conventional dedicated leading edge cooling circuit 36 in which another portion of the cooling air 20 is channeled radially upwardly behind the leading edge 26 either in another radial serpentine cooling circuit, or with an impingement bridge or partition directing the cooling air in jets for impingement cooling the leading edge from its inside. The spent impingement air may then be discharged at the leading edge through one or more rows of conventional film cooling holes.

In accordance with the present invention, the airfoil 14 illustrated in FIG. 1 includes an axial or chordal serpentine cooling circuit 38 configured for channeling another portion of the cooling air 20 primarily in the axial direction along the airfoil chord in multiple axial passes. In contrast to the radial serpentine circuit 34 illustrated in FIG. 1, the axial serpentine circuit 38 channels the cooling air primarily axially instead of radially, with the cooling air being turned between passes in the radial direction as opposed to the axial direction.

More specifically, the airfoil 1 4 preferably includes a plurality of discrete axial serpentine cooling circuits 38 stacked in a radial row. A common supply channel 40 extends radially upwardly from the dovetail 18 and through the airfoil 14 to its tip, and is disposed in flow communication with the several axial serpentine circuits 38 for supplying the cooling air 20 thereto.

In an exemplary embodiment, the several axial serpentine circuits 38 may be conventionally cast between the airfoil sidewalls 22,24 at the trailing edge 28 and are defined by corresponding ribs or partitions therebetween.

Figure 2:
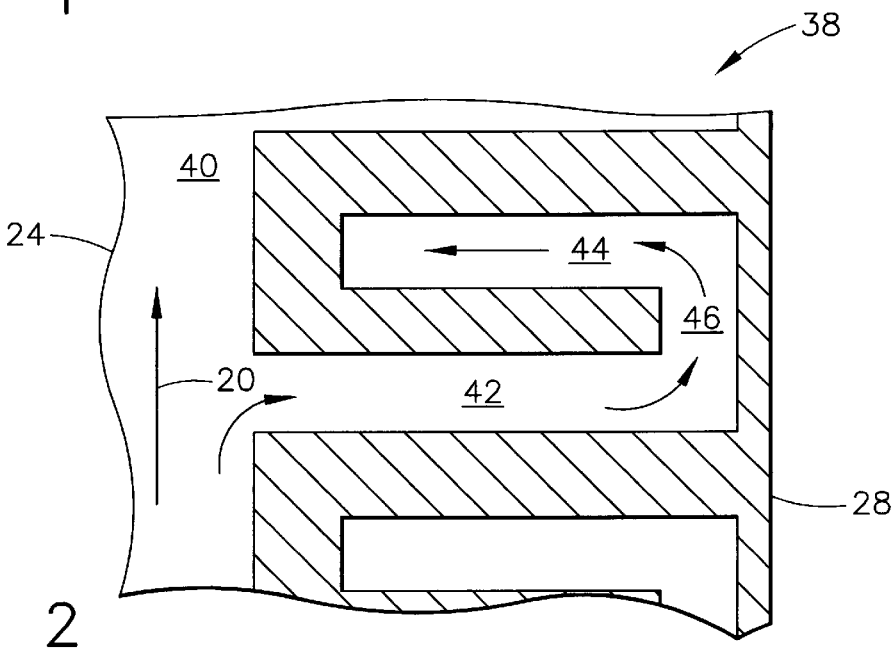
FIG. 2 is an enlarged sectional view of a portion of an axial serpentine cooling circuit of the airfoil illustrated in FIG. 1 in accordance with an exemplary embodiment of the present invention.

An exemplary one of the axial serpentine circuits 38 is illustrated in more detail in FIG. 2 and includes a first or inlet channel 42 disposed in flow communication with the supply channel 40, and extending axially therefrom to the trailing edge 28. A second, or discharge channel 44 is spaced radially from the first channel 42 and extends axially away from the trailing edge 28. A third or reversing channel 46 extends radially along the trailing edge 28 in flow communication with both the first and second channels for channeling and redirecting the cooling air therebetween.

The first and second channels 42,44 are defined between corresponding axially extending partitions which bridge the two sidewalls 22,24, with the channels and partitions being parallel to each other and extending in the axial direction. The second channel 44 receives the cooling air 20 from the third channel 46 after it is turned 1800 from the first channel 42. The second channel 44 terminates at the partition bordering the supply channel 40 and is not otherwise in flow communication therewith.

As initially shown in FIG. 1, the trailing edge 28 is preferably imperforate, and at least one of the first and second sidewalls 22,24 includes a plurality of outlet holes 48 disposed in flow communication with respective ones of the axial serpentine circuits 38 for discharging the cooling air therefrom upstream of the trailing edge.

Figure 3:
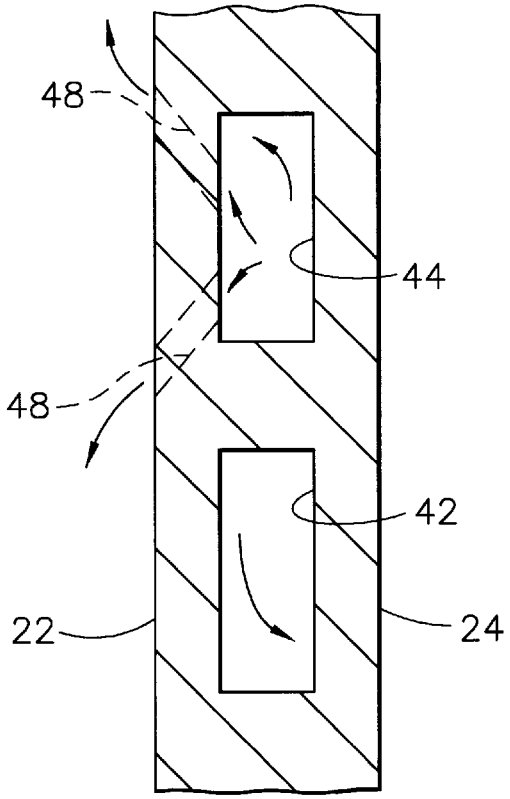
FIG. 3 is a radial, elevational sectional view through a portion of the axial serpentine cooling circuit illustrated in FIG. 1 and taken along line 3—3.
Figure 4:
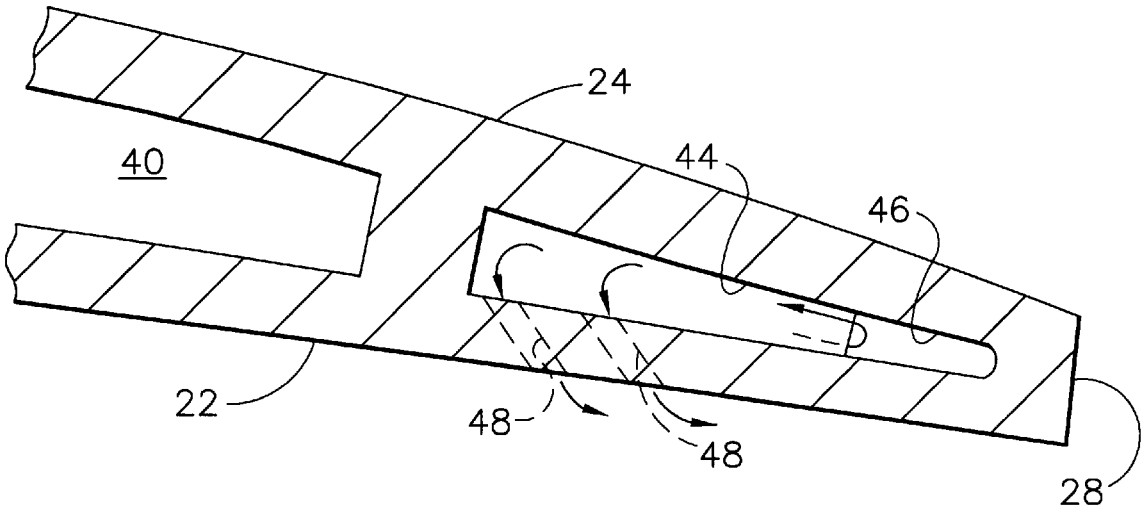
FIG. 4 is an axially extending sectional view of a portion of the axial serpentine circuit illustrated in FIG. 1 and taken generally along line 4—4.

As shown in more detail in FIGS. 3 and 4, the outlet holes 48 extend through the first sidewall 22 preferably in flow communication with the corresponding second or discharge channels 44. In this way, the relatively low temperature cooling air 20 is first channeled in the axially aft direction through the first channel 42, as illustrated in FIG. 2, reverses direction in the third channel 46 and then flows in an opposite, axially forward direction away from the trailing edge 28 for cooling this local region of the airfoil.

The cooling air thusly impinges directly against the inner surface of the trailing edge 28 as it reverses direction in the third channel 46 providing enhanced impingement and convection cooling in this region. The cooling air cools the airfoil along its travel through the three channels 42,46,44 as well as cools the trailing edge 28 from within prior to being discharged from the outlet holes 48. The available cooling potential of the cooling air 20 is thusly more effectively utilized in the circuitous axial serpentine circuit prior to being discharged from the airfoil.

As illustrated in FIG. 4, the outlet holes 48 are preferably inclined axially through the first sidewall 22 for discharging the cooling air in a cooling film therealong. As shown in FIG. 3, the outlet holes 48 are preferably also inclined radially to produce a compound inclination angle for effecting enhanced film cooling holes. The film cooling outlet holes 48 themselves may take any conventional configuration for maximizing convection and film cooling capability thereof.

In the exemplary embodiment illustrated in FIGS. 1,3, and 4, the outlet holes 48 are arranged in groups of four holes at the axially forward outlet ends of the several second channels 44 inclined in the axially aft direction. The four holes are also disposed in pairs of two holes inclined oppositely radially outwardly and inwardly.

In the preferred embodiment illustrated in FIG. 4, the outlet holes 48 are disposed in the first sidewall 22, which defines the concave, pressure sidewall of the airfoil, instead of the second sidewall 24 which defines the convex, suction sidewall of the airfoil. The pressure side film cooling from the holes 48 further reduces trailing edge temperatures in contrast to providing the outlet holes on the convex side of the airfoil. However, in an alternate embodiment, the outlet holes may be disposed through the convex, suction side.

Figure 5:
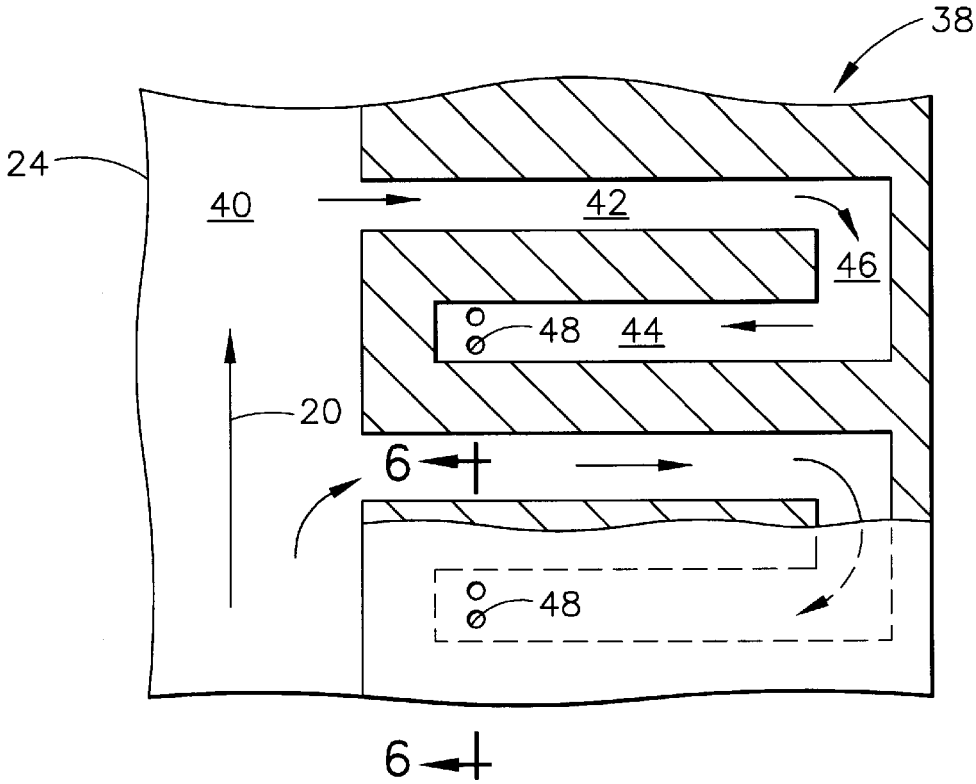
FIG. 5 is a partly sectional radial view of a portion of the airfoil illustrated in FIG. 1 showing an axial serpentine cooling circuit in accordance with another embodiment of the present invention.

In the exemplary embodiment illustrated in FIG. 2, the second channel 44 is disposed radially outwardly of the first channel 42, with the cooling air 20 initially flowing axially aft towards the trailing edge 28 and then being turned radially outwardly into the second channel 44. FIG. 5 illustrates an alternate embodiment of the present invention wherein the respective second channels 44 are disposed radially inwardly of their corresponding first channels 42, with the respective third channels 46 channeling the cooling flow radially inwardly from the first channel to the second channel. And, in yet another embodiment (not shown), FIGS. 2 and 5 may be combined, with the first channel 42 feeding two second channels 44 disposed radially above and below the common first channel in a general T-configuration.

Figure 6:
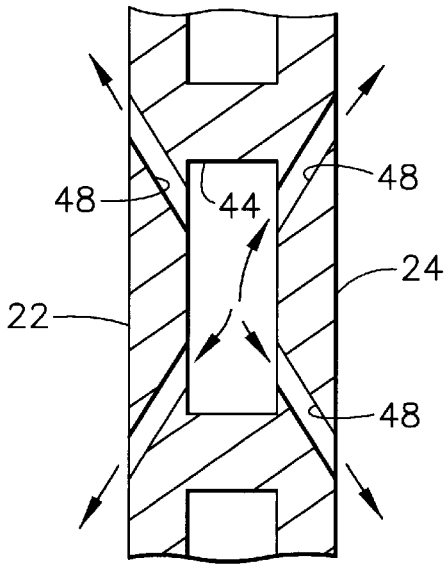
FIG. 6 is a radial, elevational sectional view through a portion of the serpentine circuit illustrated in FIG. 5 and taken along line 6—6.

As shown in FIGS. 5 and 6, the outlet holes 48 again are disposed at the forward ends of the second channels 44, and preferably in pairs through both sidewalls 22,24. The outlet holes 48 are preferably colinearly aligned in pairs on opposite sides of the airfoil and intersect each other in a general X-configuration as illustrated in FIG. 6. This may be conventionally accomplished using laser drilling.

The various embodiments of the axial serpentine cooling circuits 38 disclosed above preferably are limited to two passes for maximizing the cooling effectiveness of the coolant. Each serpentine circuit 38 is independently provided with a portion of the cooling air 20 from the common supply channel 40 for maximizing the cooling effectiveness thereof along the entire radial span of the airfoil at the trailing edge 28. In alternative embodiments, more than two passes may be utilized in the axial serpentine circuits, with the additional passes having higher temperature cooling air therein as the air absorbs heat.

In further embodiments, the first and second channels 42,44 may be inclined in part in the radial direction, in addition to their axial flow direction, for tailoring trailing edge cooling. The channels may be parallel to each other, or may radially converge or diverge toward the trailing edge.

Since the trailing edge region of the airfoil as illustrated in FIG. 4 is relatively thin, the axial serpentine circuits 38 may be simply formed therein by casting corresponding partitions therefor. The respective first channels 42 accordingly laterally or circumferentially converge toward the trailing edge 28 for accelerating the cooling air thereagainst, with the second channels 44 diverging away from the trailing edge for diffusing the cooling air prior to discharge from the film cooling outlet holes 48. The accelerated airflow increases internal heat transfer convection for improving trailing edge region cooling where it is needed most.

Yet further, by maintaining the trailing edge 28 itself imperforate, and providing the outlet holes 48 upstream therefrom, the cooling air discharged therefrom is available for additionally film cooling the airfoil upstream of the trailing edge for additional benefit, instead of discharging the cooling air directly out of the trailing edge 28 itself.

If desired, the axial serpentine cooling circuits 38 may further include conventional turbulators or other convection enhancing features therein for better utilizing the cooling air channeled therethrough. And, the axial serpentine circuits may be used at other locations of the airfoil as desired.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

1. A gas turbine engine airfoil having an axial serpentine cooling circuit terminating therein.

2. An airfoil according to claim 1 further comprising a plurality of said serpentine circuits stacked in a radial row.

3. An airfoil according to claim 2 further comprising a common radial supply channel disposed in flow communication with said serpentine circuits for supplying cooling air thereto.

4. A gas turbine engine airfoil comprising:

first and second sidewalls joined together at axially opposite leading and trailing edges and extending longitudinally from a root to a tip; and a plurality of axial serpentine cooling circuits stacked in a radial row between said first and second sidewalls at said trailing edge.

5. An airfoil according to claim 4 wherein said trailing edge is imperforate, and said first sidewall includes a plurality of outlet holes disposed in flow communication with respective ones of said serpentine circuits for discharging said cooling air therefrom upstream of said trailing edge.

6. An airfoil according to claim 5 wherein each of said serpentine circuits comprises:

a first channel disposed in flow communication with said supply channel, and extending axially to said trailing edge;

a second channel spaced radially from said first channel and extending axially away from said trailing edge; and a reversing channel extending radially along said trailing edge in flow communication with both said first and second channels for channeling said cooling air therebetween.

7. An airfoil according to claim 6 wherein said outlet holes extend through said first sidewall in flow communication with said second channels.

8. An airfoil according to claim 7 wherein said outlet holes are inclined axially through said first sidewall for discharging said cooling air in a cooling film therealong.

9. An airfoil according to claim 8 wherein said outlet holes are further inclined radially.

10. An airfoil according to claim 8 wherein first sidewall is a concave, pressure sidewall of said airfoil, and said second sidewall is a convex, suction sidewall of said airfoil.

11. An airfoil according to claim 6 wherein said second channels are disposed radially outwardly of respective ones of said first channels.

12. An airfoil according to claim 6 wherein said second channels are disposed radially inwardly of respective ones of said first channels.

13. An airfoil according to claim 6 wherein said first channels converge, and said second channels diverge.

14. An airfoil according to claim 7 wherein said outlet holes are disposed at axially forward ends of said second channels.

15. An airfoil according to claim 7 wherein said outlet holes are disposed in pairs through said sidewalls, and are colinearly aligned in an X-configuration.

16. A gas turbine engine airfoil comprising:

first and second sidewalls joined together at axially opposite leading and trailing edges and extending longitudinally from a root to a tip;

a plurality of axial serpentine cooling circuits stacked in a radial row between said first and second sidewalls; and a common radial supply channel disposed in flow communication with said serpentine circuits for supplying cooling air thereto.

17. An airfoil according to claim 16 wherein each of said serpentine circuits comprises:

a first channel disposed in flow communication with said supply channel, and extending axially toward said trailing edge;

a second channel spaced radially from said first channel and extending axially toward said leading edge; and a reversing channel extending radially between said first and second channels in flow communication therewith for channeling said cooling air therebetween.

18. An airfoil according to claim 17 wherein said first sidewall includes a plurality of outlet holes disposed in flow communication with respective ones of said serpentine circuits for discharging said cooling air therefrom.

19. An airfoil according to claim 18 wherein said outlet holes extend through said first sidewall in flow communication with said second channels.

20. An airfoil according to claim 19 wherein:

said trailing edge is imperforate;

said axial serpentine cooling circuits are disposed at said trailing edge and terminate thereat; and said outlet holes are disposed upstream of said trailing edge.

* * * * *